US012484718B1

(12) United States Patent
Warren

(10) Patent No.: US 12,484,718 B1
(45) Date of Patent: Dec. 2, 2025

(54) BLANKET WITH LIMB OPENINGS

(71) Applicant: Violet Capital Enterprises LLC, Chicago, IL (US)

(72) Inventor: Kevin F. Warren, Chicago, IL (US)

(73) Assignee: Violet Capital Enterprises LLC, Chicago, IL (US)

( * ) Notice: Subject to any disclaimer, the term of this patent is extended or adjusted under 35 U.S.C. 154(b) by 367 days.

(21) Appl. No.: 17/992,044

(22) Filed: Nov. 22, 2022

Related U.S. Application Data

(60) Provisional application No. 63/301,590, filed on Jan. 21, 2022.

(51) Int. Cl.
*A47G 9/02* (2006.01)

(52) U.S. Cl.
CPC ..... *A47G 9/0223* (2013.01)

(58) Field of Classification Search
CPC ..... A47G 9/0223; A47G 9/0207; A47G 9/02; A47G 9/0238; A61B 46/00; A61B 46/20; A61B 46/23
See application file for complete search history.

(56) References Cited

U.S. PATENT DOCUMENTS 1,547,085 A * 7/1925 Tucker ..... A47G 9/0207 5/413 R
2,722,694 A 11/1955 Bryant
3,344,446 A * 10/1967 Tritt ..... A61F 5/04 5/482
4,062,076 A 12/1977 Albertson
4,367,728 A * 1/1983 Mutke ..... A61G 10/005 128/853

(Continued)

FOREIGN PATENT DOCUMENTS

CH 62965 11/1912
CN 2509952 Y * 9/2002

(Continued)

OTHER PUBLICATIONS

"How a Blanket is set to be your ultimate winter wardrobe staple: With months of outdoor socialising ahead, Femail reveals 8 ways to wear the unlikely accessory for maximum style and warmth" article from https://www.dailymail.co.uk/femail/article-8884535/How-BLANKET-ultimate-winter-wardrobe-staple.html, published Oct. 29, 2020, accessed Oct. 19, 2021 (4 pages).

(Continued)

*Primary Examiner* — Eric J Kurilla
(74) *Attorney, Agent, or Firm* — Mai D. Lauer; Westman, Champlin & Koehler, P.A.

(57) ABSTRACT

A blanket includes a material in sheet form with first and second openings. The material has a length between first and second end edges and a width between first and second side edges. The first opening is disposed at a first distance from the first end edge and is disposed at a second distance from the first side edge that is closer to the first side edge than to the second side edge. The second opening is disposed at a third distance from the first end edge that is less than the first distance and is disposed at substantially the second distance from the first side edge. Methods of using a blanket include extending or accessing a portion of a human body through at least one of the first and second openings.

13 Claims, 2 Drawing Sheets

(56) References Cited

U.S. PATENT DOCUMENTS

| | | | | |
|---|---|---|---|---|
| 4,479,492 | A * | 10/1984 | Singer | A61B 46/00 128/853 |
| 4,553,539 | A * | 11/1985 | Morris | A61B 46/00 128/854 |
| 5,143,091 | A * | 9/1992 | Patnode | A61B 46/27 128/853 |
| 5,443,488 | A * | 8/1995 | Namenye | A61F 7/0097 607/104 |
| 5,735,890 | A | 4/1998 | Kappel et al. | |
| 5,813,407 | A | 9/1998 | Busch | |
| 6,349,411 | B1 | 2/2002 | Tyler | |
| 6,568,007 | B1 * | 5/2003 | Hatcher | A47G 9/0223 112/475.08 |
| 6,640,362 | B1 * | 11/2003 | Kimball | A47G 9/0223 128/854 |
| 7,594,287 | B2 | 9/2009 | Framer | |
| 7,752,690 | B1 * | 7/2010 | Seth | A47G 9/086 5/413 R |
| 7,766,950 | B2 | 8/2010 | Castellani et al. | |
| D681,383 | S * | 5/2013 | Derman | D6/603 |
| D785,371 | S * | 5/2017 | Volpe, II | D6/602 |
| D791,511 | S | 7/2017 | Walker | |
| D839,546 | S * | 2/2019 | Noiberg | D2/826 |
| 10,681,997 | B1 * | 6/2020 | Rigas | A47C 31/11 |
| 10,874,230 | B2 | 12/2020 | Green | |
| 2006/0021140 | A1 * | 2/2006 | Cha | A47G 9/0207 5/482 |
| 2006/0021141 | A1 * | 2/2006 | Shima | A47G 9/0207 5/482 |
| 2006/0174409 | A1 * | 8/2006 | Hermanson | A47G 9/0223 2/69.5 |
| 2006/0200907 | A1 * | 9/2006 | Cha | A47G 9/0207 5/482 |
| 2008/0047063 | A1 * | 2/2008 | Jay | A47G 9/0207 5/482 |
| 2008/0172788 | A1 | 7/2008 | Rosen | |
| 2009/0013467 | A1 * | 1/2009 | Moorhouse | A47G 9/02 5/495 |
| 2010/0198320 | A1 | 8/2010 | Pierre et al. | |
| 2011/0259347 | A1 * | 10/2011 | Zurn | A61B 46/00 128/849 |
| 2014/0352052 | A1 * | 12/2014 | Hetland | A47K 3/001 4/559 |
| 2017/0049254 | A1 * | 2/2017 | Palmer | A47G 9/0223 |
| 2017/0295961 | A1 * | 10/2017 | Alletto | A47G 9/0207 |
| 2017/0295963 | A1 * | 10/2017 | Howland | A47G 9/0223 |
| 2019/0208933 | A1 * | 7/2019 | Ropchan | A47G 9/0207 |
| 2019/0343305 | A1 * | 11/2019 | Cubbler | A47G 9/0253 |
| 2019/0374050 | A1 * | 12/2019 | Davis | A47G 9/0223 |
| 2019/0380516 | A1 * | 12/2019 | Davis | A47G 9/0223 |
| 2020/0078535 | A1 | 3/2020 | Sinha et al. | |
| 2021/0000270 | A1 * | 1/2021 | Ropchan | A47G 9/0215 |
| 2022/0125225 | A1 * | 4/2022 | Leotta | A47G 9/0223 |
| 2023/0014076 | A1 * | 1/2023 | Lundquist | A47G 9/0223 |

FOREIGN PATENT DOCUMENTS

| | | | | |
|---|---|---|---|---|
| EP | 0698378 | A1 * | 2/1996 | |
| EP | 4265157 | A1 * | 10/2023 | A47G 9/0207 |
| KR | 200201407 | Y1 * | 11/2000 | |
| KR | 10-1021482 | | 3/2011 | |

OTHER PUBLICATIONS

"Sunbeam Extra Warm Weighted Blanket | 15 Pounds, Reversible Plush Velvet/Microfiber with Arm Slits and Neck Cutout, 54"×73", Mushroom" online catalog from https://www.amazon.com/Sunbeam-Weighted-Reversible-Mircofiber-Mushroom/dp/B07TKZ56DG, accessed Oct. 19, 2021 (9 pages).

"Blanket/ the Leggie the blanket with a leg hole. The next big thing in blankets (patent pending)/ Home Decor/ Plush Blanket/ Black and White" online catalog from https://www.etsy.com/listing/260370725/blanket-the-leggie-the-blanket-with-a?show_sold_out_detail=1&ref=nla_listing_details, accessed Oct. 28, 2021 (5 pages).

"The Not Hot Blanket" article from https://www.unnessecaryinventions.com/the-not-hot-blanket%EF%B8%8F/, dated May 26, 2020, accessed Oct. 19, 2021 (7 pages).

* cited by examiner

BLANKET WITH LIMB OPENINGS

CROSS REFERENCE TO RELATED APPLICATIONS

This application claims the benefit of priority of U.S. Provisional Patent Application No. 63/301,590, filed Jan. 21, 2022. The content of this priority application is hereby incorporated by reference in its entirety.

BACKGROUND

Blankets are often used in hospitals and other medical settings to keep a patient warm while receiving treatment. Moreover, medical drapes can cover a patient to offer privacy without concern for warm, necessarily. However, in some cases, a body part that warrants treatment is not readily accessible from beneath a blanket or drape without exposing other body parts. Additionally, some attempts to expose just a particular body part result in bunching of the blanket or covering around that part, leading to discomfort around the bulky mass of material. Thus, this disclosure is related to a blanket or other covering that allows for covering most of a patient's body, while allowing for exposure of a selected body part.

SUMMARY

In one aspect, a blanket comprises a material in sheet form and first and second openings in the material. The material has a length between first and second end edges and a width between first and second side edges. The first opening is disposed at a first distance from the first end edge and is disposed at a second distance from the first side edge; the first opening is closer to the first side edge than to the second side edge. The second opening is disposed at a third distance from the first end edge that is less than the first distance and is disposed at substantially the second distance from the first side edge. One method of using a blanket comprises extending a portion of a human body through at least one of the first and second openings. Another method of using a blanket comprises accessing a portion of a human body through at least one of the first and second openings.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

Figure 1:
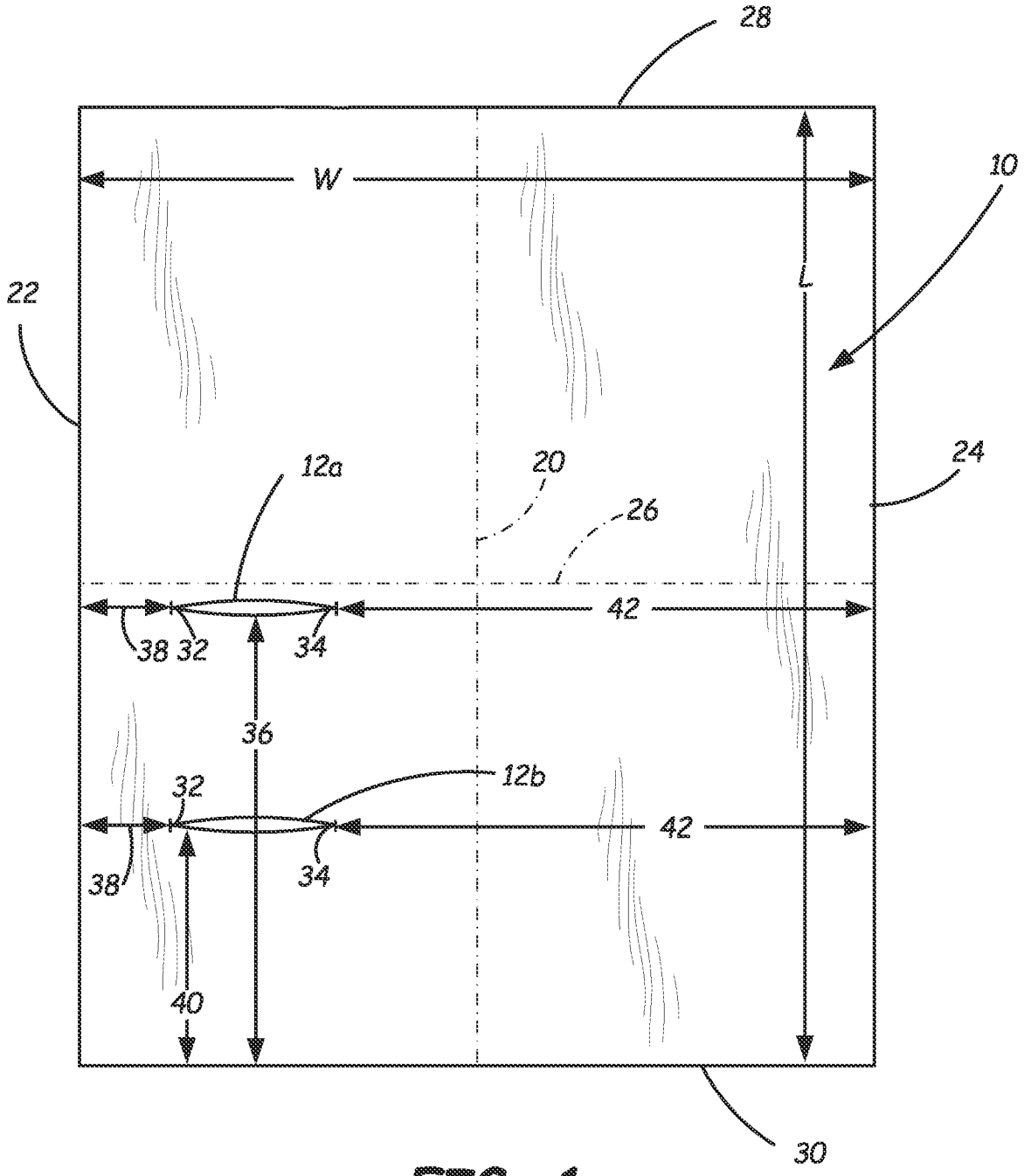
FIG. 1 is a top view of an exemplary blanket having two openings therethrough.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

The same or similar reference numerals are used in different figures for the same or similar elements. All descriptions of an element also apply to all other versions of that element unless otherwise stated. The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

As shown in the drawing figures, an exemplary blanket 10 has a plurality of openings 12 therethrough to allow an injured limb of a patient 14 to be readily accessed for the application of ice or another treatment. For example, as shown in FIGS. 2-5, a patient 14 may allow a part of a leg 16 or arm 18 to extend out of an opening 12 of a blanket 10 while a remainder of the patient's body remains covered and warm. As with most blanket usage methods, a user 14 typically leaves his or her head 15 uncovered. Alternatively, each opening 12 allows passage through blanket 10 of medical equipment for contact with a body part of patient 14, such as for treatment of that body part.

In many instances, access to a patient's body part, such as an arm 18 or leg 16 is desirable, such as after surgery, for application of ice or another treatment. However, conventional bedding covers such as sheets and blankets, when manipulated to allow such access, uncover and expose too much of the patient's body or cause undue disturbance. Access to a portion of a patient's body is used in many procedures, such as monitoring with equipment, providing intravenous medication, and providing treatment such as with an ice machine, for example. Access to a portion of a body also allows a medical provider to observe the body part visually and tactically. The exemplary openings 12 and their placement on the blanket 10 allow for such access and for the attachment of equipment and cords to the body part without causing entanglement. Such undesirable entanglement can cause medical equipment to sound alarms, thereby interfering with a patient's rest and potentially delaying his or her recovery. Moreover, with a conventional blanket (without openings), getting access a patient's limbs may involve patient or limb movement, with associated discomfort or potential dislocation.

In an exemplary embodiment, a blanket 10 has selectively placed openings 12 (or openable slits, such as ones that can be closed with a zipper, hook and loop fasteners, snap fasteners, buttons, adhesive or tape, for example) through which a user 14 may extend a body part or through which medical equipment can be attached to the user 14, while the user 14 remains warmly covered by the remainder of the blanket 10. As shown in FIGS. 1-5, the blanket 10 can have two openings 12 on one side of the blanket 10, through which the user 14 can extend partial or full appendages such as leg 16 or arm 18. Moreover, the accessible openings 12 allow for the passage of equipment cords and intravenous tubing, for example, without tangling around conventional blanket masses, to reach any part of the body. In an exemplary embodiment, a specialized textile can be used for the blanket material to decrease a risk of infection, such as one incorporating materials that are antimicrobial, antibacterial and/or antifungal, for example.

In an exemplary embodiment, blanket 10 is configured as a substantially rectangular sheet material having a length L and a width W. These dimensions are marked on FIG. 1 for ease of description; however, it is to be understood that the blanket 10 can have other shapes, including those in which the width is greater than the length dimension, and wherein the blanket has an outer perimeter shape that is other than substantially rectangular; such as having the shape of a parallelogram, trapezoid, hexagon, oval, square, circle or other suitable shape for a blanket. In an exemplary embodiment, blanket 10 is made of one or more layers of a flexible sheet material, such as textiles and paper-based fabrics designed to cover a patient and provide warmth, visual coverage, and a barrier against drafts, dust, germs, and other contaminants, for example.

In an exemplary embodiment, the blanket 10 has two sides or surfaces within a perimeter defined by the edges 22, 24, 28, 30. A length L of the blanket 10 is defined between the first end edge 28 and the second end edge 30. A width W of the blanket is defined between the first side edge 22 and the second side edge 24. In an exemplary embodiment, vertical center line 20 bisects the blanket 10 at its width dimension W between first side edge 22 and second side edge 24. Similarly, horizontal center line 26 bisects blanket 10 between first end edge 28 and second end edge 30. Each of the edges 22, 24, 28 and 30 is depicted as a substantially straight line, with edges 22 and 24 being parallel to each other and edges 28 and 30 being parallel to each other. However, it is contemplated that these edges may have other configurations and dispositions, such as being curved, undulating, and not parallel to each other. Generally, the center lines are depicted as running through a mid-point of opposed edges, whether or not those edges are straight. It is to be understood that the vertical center line 20 and horizontal center line 26 are not physical structures of the blanket but are merely provided in this description for reference, in order to more particularly recite locations of openings 12 on the blanket 10.

In an exemplary embodiment, a plurality of openings 12 are disposed on the blanket 10, wherein the openings are not centered vertically or horizontally on the blanket 10. As illustrated in FIG. 1, each of the plurality of openings 12 is configured as a slit between first opening end 32 and second opening end 34. In another embodiment, an opening 12 extends all the way to first side edge 22 and therefore does not have an end 32. In an exemplary embodiment, the longitudinal extent of a slit opening 12 is substantially aligned parallel to an end edge 28 or 30. However, openings 12 need not be straight, parallel lines as illustrated; they could be slanted or curved, for example. Other opening configurations include slots, holes and notches, for example.

While two openings 12*a*, 12*b* are illustrated in the exemplary embodiments, more or fewer such openings may be provided on a blanket 10. In many respects, the openings are similar to each other, and when referred to generically, the reference number 12 may be used. When a particularly located opening is being described, this disclosure may refer to the opening of 12*a* or opening 12*b*. In an exemplary embodiment, opening 12*a* is disposed at a first distance 36 from end edge 30 (first distance 36 is a shortest distance between opening 12*a* and the nearest end edge 30). In an exemplary embodiment, a second opening 12*b* is disposed at third distance 40 from the second end edge 30 of the blanket 10 (third distance 40 is a shortest distance between opening 12*b* and its closest end edge 30). Each of the openings 12*a*, 12*b* is also located at a common second distance 38 from the first side edge 22 of the blanket 10. The second distance 38 could be zero in a case where the opening 12 extends to the first side edge 22. Moreover, each of the openings 12 has its second opening end 34 located at a distance 42 from the second side edge 24.

In an exemplary embodiment, first distance 36 is greater than third distance 40 so that the openings 12*a*, 12*b* are spaced at different distances from their closest end edge 30. In an exemplary embodiment, the first distance 36 is substantially greater than the third distance 40, resulting in a placement of openings 12*a*, 12*b* wherein all of the plurality of openings 12 of a blanket 10 are offset toward one side of horizontal center line 26, though an opening 12 may overlap the horizontal center line 26.

In an exemplary embodiment, fourth distance 42 is greater than second distance 38 so that the openings 12*a*, 12*b* are closer to one side edge 22, 24 than the other. In an exemplary embodiment, the fourth distance 42 is substantially greater than the second distance 38, resulting in a placement of openings 12*a*, 12*b* wherein all of the plurality of openings 12 of a blanket 10 are offset toward one side of vertical center line 20, though an opening 12 may overlap the vertical center line 20.

In an exemplary embodiment, each of the openings 12 has a common length and is positioned at a same distance 38 from a first side edge 22 and at a same distance 42 from a second side edge 24. However, variations are possible. Moreover, in some cases the length of openings 12*a*, 12*b* along their longitudinal extent is different; thus, a distance between ends 32, 34 of opening 12*a* may be different than a distance between ends 32, 34 of a different opening 12*b*. These variations will also affect the distances 38, 42 for each opening 12*a*, 12*b*.

In an exemplary embodiment, opening 12*a* is positioned closer to horizontal center line 26, and opening 12*b* is positioned farther from horizontal center line 26. In the illustrated examples, each of the openings 12*a*, 12*b* is substantially linear with a longitudinal extent that is substantially parallel to one of the edges 22, 24, 28, 30. Moreover, each of the openings 12*a*, 12*b*, as illustrated is linear and is substantially parallel to the other openings 12 of the blanket 10. In other cases, the openings 12 may have other configurations, such as slanted or curved, for example. In an exemplary embodiment, all of the plurality of openings 12 of a blanket 10 are located in a single quadrant of the blanket 10, wherein four such quadrants are defined by the center lines 20, 26. One or more of the openings 12 may also extend onto the other quadrants.

Figure 2:
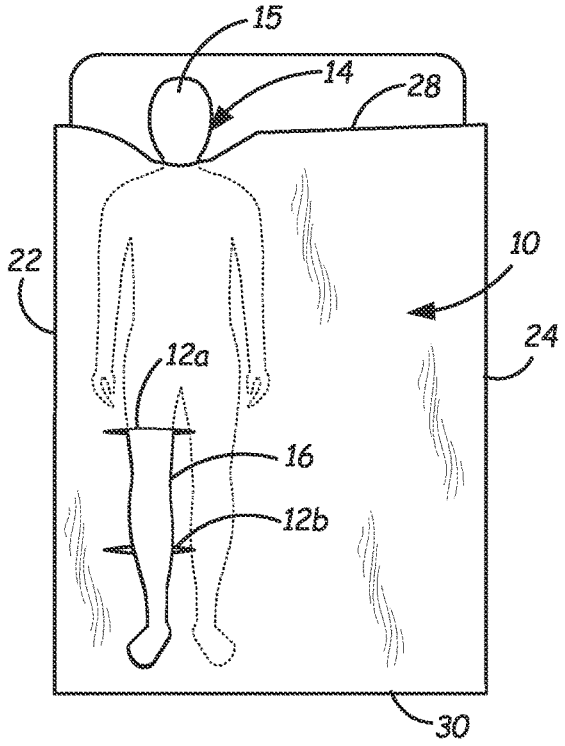
FIG. 2 is a top view of the blanket in a first use configuration.
Figure 3:
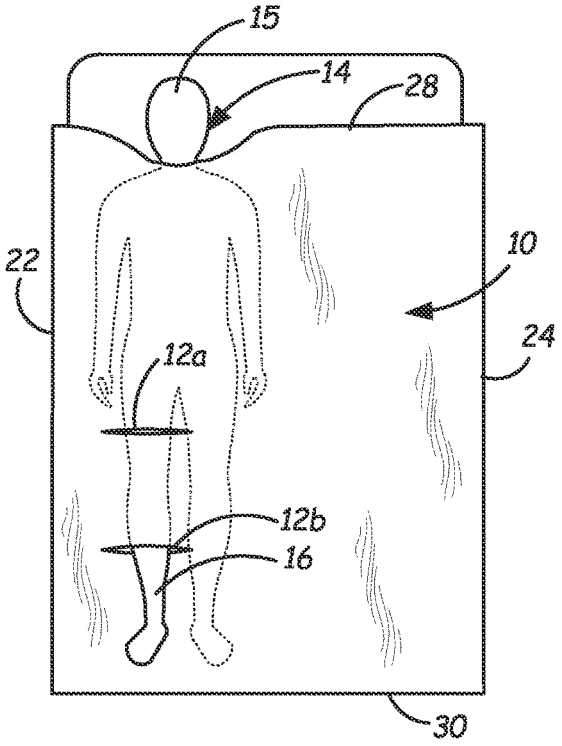
FIG. 3 is a top view of the blanket in a second use configuration.

FIGS. 2-5 show blanket 10 in various use configurations, though other uses are possible. As illustrated, blanket 10 is generously sized to allow full coverage and is easily manipulated to expose body parts (for example, an end edge is pulled down below the user's chin). FIG. 2 shows blanket 10 in a first method of use, wherein a portion of a user's leg 16 is extended out through opening 12*a*, while a remainder of the user 14 is covered by the blanket 10 except for an area around his or her head 15. FIG. 3 shows another implementation of use of blanket 10, wherein only a distal extremity of leg 16 is exposed outside blanket 10. In this case, the user's foot, ankle and lower calf can be inserted outward through opening 12*b*, while the remainder of the user 14 is covered by blanket 10.

Figure 4:
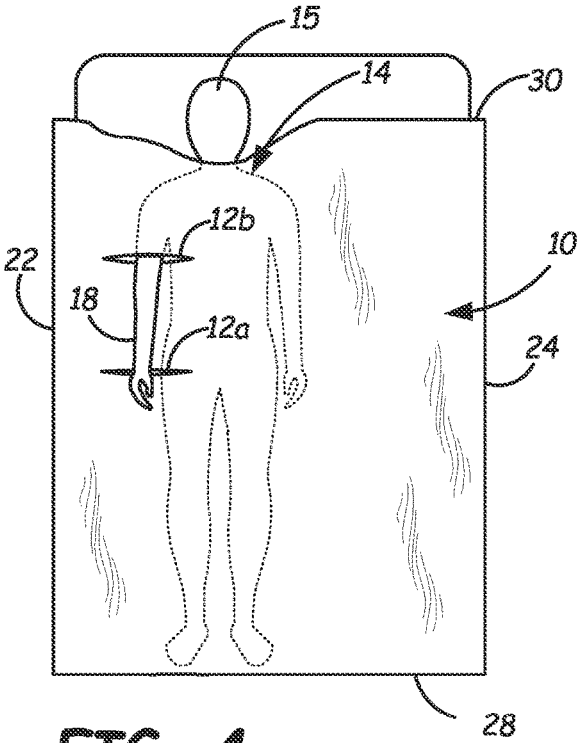
FIG. 4 is a top view of the blanket in a third use configuration.
Figure 5:
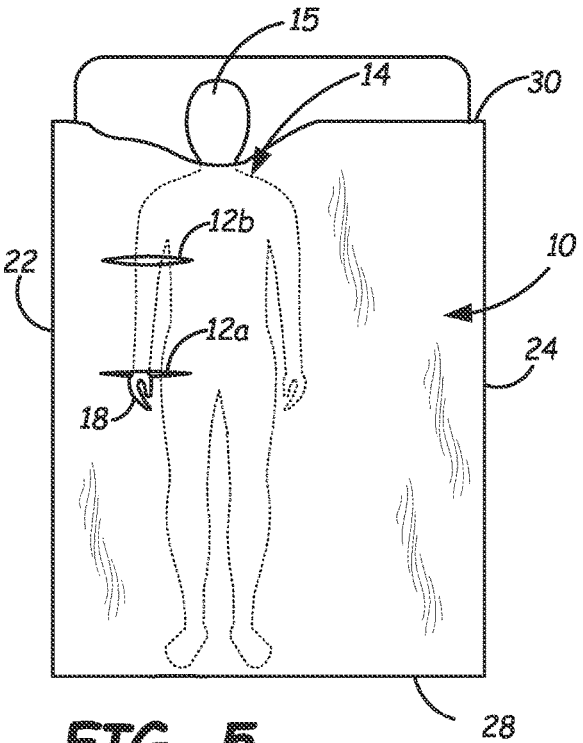
FIG. 5 is a top view of the blanket in a fourth use configuration.

FIGS. 4 and 5 show blanket 10 in an inverted configuration compared to the position in FIGS. 2 and 3. As used in FIGS. 4 and 5, the first end edge 28 is disposed near the feet of the user 14 and the second end edge 30 is located near the head 15 of the user 14 so that the openings 12*a*, 12*b* are positioned over an upper part of the user's body. As shown in FIG. 4, where more of the arm is to be exposed outside of blanket 10, the user 14 inserts his or her arm 18 through the opening 12*b* that is closer to an end edge of the blanket, namely end edge 30. In contrast, in FIG. 5, wherein only a distal extremity of the arm 18, namely the user's hand, is exposed outside of blanket 10, the user may insert his or her hand out of the blanket opening 12*a* while the remainder of his or her body remains covered and warm.

Because a person's limbs, namely arms and legs, are generally positioned on a left or right side of the body when the user lies in a prone, upward facing position, as shown in FIGS. 2-5, the openings 12 are offset from the vertical center line 20 so that a portion of a single arm 18 or leg 16 can be extended through one of the openings 12, while the user's core and other body side remain covered and warm. All of the illustrations in FIGS. 2-5 show a user's right-side appendages extended through the openings 12 (left side from a viewer's standpoint). However, it is to be understood that if the user's left appendage were to be extended through one of the openings 12, the blanket 10 could be flipped over so that the first side edge 22 is placed closer to the user's left side of the body. Thus, the blanket 10 has a configuration that can be used in many different modes, depending on the appendage to be inserted through an opening and the extent of which the appendage should be exposed. As shown in FIGS. 2 and 4, extensive portions of an appendage 16, 18 can be extended through an opening 12; such a portion can be elevated in a sling, for example, without lifting the entire blanket 10 from the user's body.

In exemplary embodiments, the blanket 10 is finished for comfort on both end edges 28, 30, as either of those edges may be disposed near the user's face and neck. Moreover, the blanket is finished on both major sides thereof so that both the front and the back of the blanket are comfortable and soft against the skin and also have desirable qualities of stain resistance and a non-slip texture. The fabrication of blanket 10 can be customized to its particular use. For example, for use in surgery, the sheet materials may be single use, disposable materials, similar to those used in medical drapes. In other situations less prone to exposure to bodily fluids or medicaments, the blanket 10 may be made of a fabric that can be washed and dried at high temperatures to sanitize, remove stains, and remain durable through multiple uses. As used in this disclosure, the term "blanket" means a covering, such as in the form of a sheet, surgical drape, blanket for warmth, cooling layer of material, etc., as used in medical treatment or desired for patient comfort and convenience, for example. The sheet form material for blanket 10 can have multiple layers and multiple material components if desired.

Exemplary, non-limiting embodiments of a blanket 10 and its method of use are described. In an exemplary embodiment, a blanket 10 comprises a material in sheet form with first and second openings 12. In an exemplary embodiment, the material has a length L between first and second end edges 28, 30 and a width W between first and second side edges 22, 24. In an exemplary embodiment, the first opening 12*a* is disposed at a first distance 36 from the first end edge 30 and is disposed at a second distance 38 from the first side edge 22; first opening 12*a* is closer to the first side edge 22 than to the second side edge 24. The second opening 12*b* is disposed at a third distance 40 from the first end edge 30 that is less than the first distance 36; the second opening 12*b* is disposed at substantially the second distance 38 from the first side edge 22.

In an exemplary embodiment, the first opening 12*a* is configured as a first slit having a first opening length between its ends 32 and 34, and the second opening 12*b* is configured as a second slit having a second opening length between its ends 32 and 34. In an exemplary embodiment, the first opening length substantially equals the second opening length. In an exemplary embodiment, the first opening 12*a* is substantially parallel to the second opening 12*b*. In an exemplary embodiment, at least one of the first and second openings 12*a*, 12*b* is substantially parallel to at least one of the first and second end edges 28, 30.

In an exemplary embodiment, the blanket 10 comprises a vertical center line 20 between the first and second side edges 22, 24, and both of the first and second openings 10*a*, 10*b* are offset toward one side of the vertical center line 20. In an exemplary embodiment, the blanket 10 comprises a horizontal center line 26 between the first and second end edges 22, 24, and both of the first and second openings 12*a*, 12*b* are offset toward one side of the horizontal center line 26. In an exemplary embodiment, the vertical center line 20 and the horizontal center line 26 divide the sheet-like layer of material into four quadrants, and at least a part of each of the first and second openings 12 is positioned on a common one of the four quadrants. In an exemplary embodiment, the material comprises an anti-microbial component.

In an exemplary embodiment, a method of using the blanket 10 comprises extending a portion of a human body through at least one of the first and second openings 12. Moreover, it is possible to insert a body portion through two openings at once; for example, in FIG. 2, the user could insert his or her right foot and ankle under the blanket 10 through opening 12*b*, such as in a case in which it is desirable to expose only the right knee and head 15 outside the blanket 10. In an exemplary embodiment, the portion of a human body is selected from an arm 18 and a leg 16. In an exemplary embodiment, the method comprises attaching medical equipment to the portion of the human body. In an exemplary embodiment, the method of claim 10 comprises treating the portion of the human body. In an exemplary embodiment, the method comprises elevating the portion of the human body.

In an exemplary embodiment, a method of using the blanket 10 comprises accessing a portion of a human body through at least one of the first and second openings 12. In an exemplary embodiment, the portion of a human body is selected from an arm 18 and a leg 16. In an exemplary embodiment, the method comprises inserting medical equipment through at least one of the first and second openings 12. In an exemplary embodiment, the method comprises attaching the inserted medical equipment to the portion of the human body. In an exemplary embodiment, the method of comprises treating the portion of the human body.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa. All references mentioned in this disclosure are hereby incorporated by reference.

The invention claimed is:

1. A method of using a blanket, the blanket comprising:

a material in sheet form, the material having:

a length and a horizontal center line between first and second end edges;

a width and a vertical center line between first and second side edges; and first and second opposed major surfaces;

a first opening in the material, the first opening:

disposed at a first distance from the first end edge; and disposed at a second distance from the first side edge that is closer to the first side edge than to the second side edge; and a second opening in the material, the second opening:

disposed at a third distance from the first end edge that is less than the first distance; and disposed at substantially the second distance from the first side edge;

wherein both of the first and second openings are offset toward one side of the horizontal center line and toward one side of the vertical center line; and the method comprising using the blanket in one of four orientations, comprising:

a first orientation in which the first major surface faces away from a human and the first and second openings are positioned at the human's right leg, in which the human's right leg extends out of the first opening or the human's right lower leg only extends out of the second opening;

a second orientation in which the second major surface faces away from the human and the first and second openings are positioned at the human's right arm, in which the human's right hand extends out of the first opening or the human's right arm extends out of the second opening;

a third orientation in which the second major surface faces away from the human and the first and second openings are positioned at the human's left leg, in which the human's left leg extends out of the first opening or the human's left lower leg only extends out of the second opening; and a fourth orientation in which the first major surface faces away from the human and the first and second openings are positioned at the human's left arm, in which the human's left hand extends out of the first opening or the human's left arm extends out of the second opening.

2. The method of claim 1 wherein:

the first opening is configured as a first slit having a first opening length; and the second opening is configured as a second slit having a second opening length.

3. The method of claim 2 wherein the first opening length substantially equals the second opening length.

4. The method of claim 2 wherein the first slit is substantially parallel to the second slit.

5. The method of claim 2 wherein at least one of the first and second slits is substantially parallel to at least one of the first and second end edges.

6. The method of claim 1 wherein the vertical center line and the horizontal center line divide the material into four quadrants; and wherein at least a part of each of the first and second openings is positioned on a common one of the four quadrants.

7. The method of claim 1 wherein the material comprises an anti-microbial component.

8. The method of claim 1 comprising attaching medical equipment to a portion of the human that extends out the first or second opening.

9. The method of claim 1 comprising treating a portion of the human that extends out the first or second opening.

10. The method of claim 1 comprising elevating a portion of the human that extends out the first or second opening.

11. The method of claim 1, comprising accessing a portion of the human through at least one of the first and second openings.

12. The method of claim 1 comprising inserting medical equipment through at least one of the first and second openings.

13. The method of claim 12 comprising attaching the medical equipment to the human.

* * * * *